United States Patent [19]

Berg

[11] 4,109,690

[45] Aug. 29, 1978

[54] CHIPPER

[75] Inventor: Niilo Nikodemus Berg, Helsinki, Finland

[73] Assignee: Rauma-Repola OY, Finland

[21] Appl. No.: 752,424

[22] Filed: Dec. 20, 1976

[30] Foreign Application Priority Data

Dec. 23, 1975 [FI] Finland ..... 753629

[51] Int. Cl.[2] ..... B27L 11/08

[52] U.S. Cl. ..... 144/163; 144/174; 144/218; 144/326 B; 241/187; 241/229

[58] Field of Search ..... 241/187, 190, 222, 223, 241/229, 92; 144/162 R, 172, 218, 326 A, 326 B, 326 C, 326 D, 230, 163, 164, 195, 174; 83/508

[56] References Cited

U.S. PATENT DOCUMENTS

| | | | |
|---|---|---|---|
| 2,575,057 | 11/1951 | Keiper | 241/223 X |
| 2,811,183 | 10/1957 | Mottet | 144/172 X |
| 3,314,459 | 4/1967 | Beaubien | 144/172 |
| 3,856,212 | 12/1974 | Swatko | 241/222 |

FOREIGN PATENT DOCUMENTS

| | | | |
|---|---|---|---|
| 2,526,211 | 12/1976 | Fed. Rep. of Germany | 241/187 |

*Primary Examiner*—Othell M. Simpson
*Assistant Examiner*—W. D. Bray
*Attorney, Agent, or Firm*—Burns, Doane, Swecker & Mathis

[57] ABSTRACT

A chipping apparatus for producing chips from entire trees, branches, shrubs, and the like comprises a rotatable cylindrical drum having a plurality of finger-like blades projecting from the surface. An axially parallel cylindrical counter-blade, having recesses on its surface which match the projecting blades on the first drum, coacts with the latter and is arranged to rotate in the same direction. The finger-like blades are adjustable as to how far they project from the surface of the cylinder and can be arranged on the latter in two arrow-shaped staggered rows or in axially disposed parallel rows.

4 Claims, 4 Drawing Figures

1
2
3
3
6
6
7
8
9
10

CHIPPER

The subject of the present invention is a chipper for chipping various wood material, such as entire trees, branches, tree tops, bushes and small trees. The chipper comprises a rotatable, cylindrical blade drum having finger-shaped blades arranged to project from the surface and spaced from each other in the longitudinal direction of the blade drum. Further, the chipper comprises, as a unit operating jointly with the blade drum, a cylindrical counter-blade, rotating in the same direction as the blade drum the axis of rotation of the counter-blade being parallel to that of the blade drum.

The present invention is in particular concerned with a chipper by means of which it is possible, in the forest and in industrial plants, to chip entire trees, branches, tops, bushes, small trees, etc. into chips of suitable size, for use, for example in the pulp, paper, cardboard, and chipboard, industry. For these purposes the chips from the tree trunks must be of a certain uniform size and the chips from branches must be narrower than, but of the same length as the chips from trunks, because the branches are of much more solid and harder wood than the wood in the trunks. If the chips from the branches were not narrower than the chips from the trunk wood, the branch chips, for example, would not be able to be digested in the digesters for pulp production within the same period of time as the trunk chips. In such a case it would be necessary to remove the so-called branch pulp from the cellulose pulp.

The chipper in accordance with the present invention is mainly characterized by a rotating blade drum and a coacting cylindrical counter-blade rotating in the same direction as the blade drum and at the same speed (equal r.p.m.). The blade drum is provided with projecting finger-shaped blades on its surface while the surface of the cylindrical counter-blade is provided, at positions corresponding the blades, with recesses, whose shape substantially corresponds to that of the blades in order to permit rotation of the blade drum and the counter-blade at a distance from each other in which the smooth cylinder faces of the blade drum and the counter-blade are positioned very close to each other so that they do not permit chips to pass through the space between the cylinder faces. The chipper also includes a stationary counter-blade, in itself known, which is placed, when viewed in the direction of feeding of the wood material, in front of the chipper drums near the cylinder face of the counter-blade and at such a distance that all the blades of the blade drum also pass very close to said stationary counter-blade.

Figure 1:
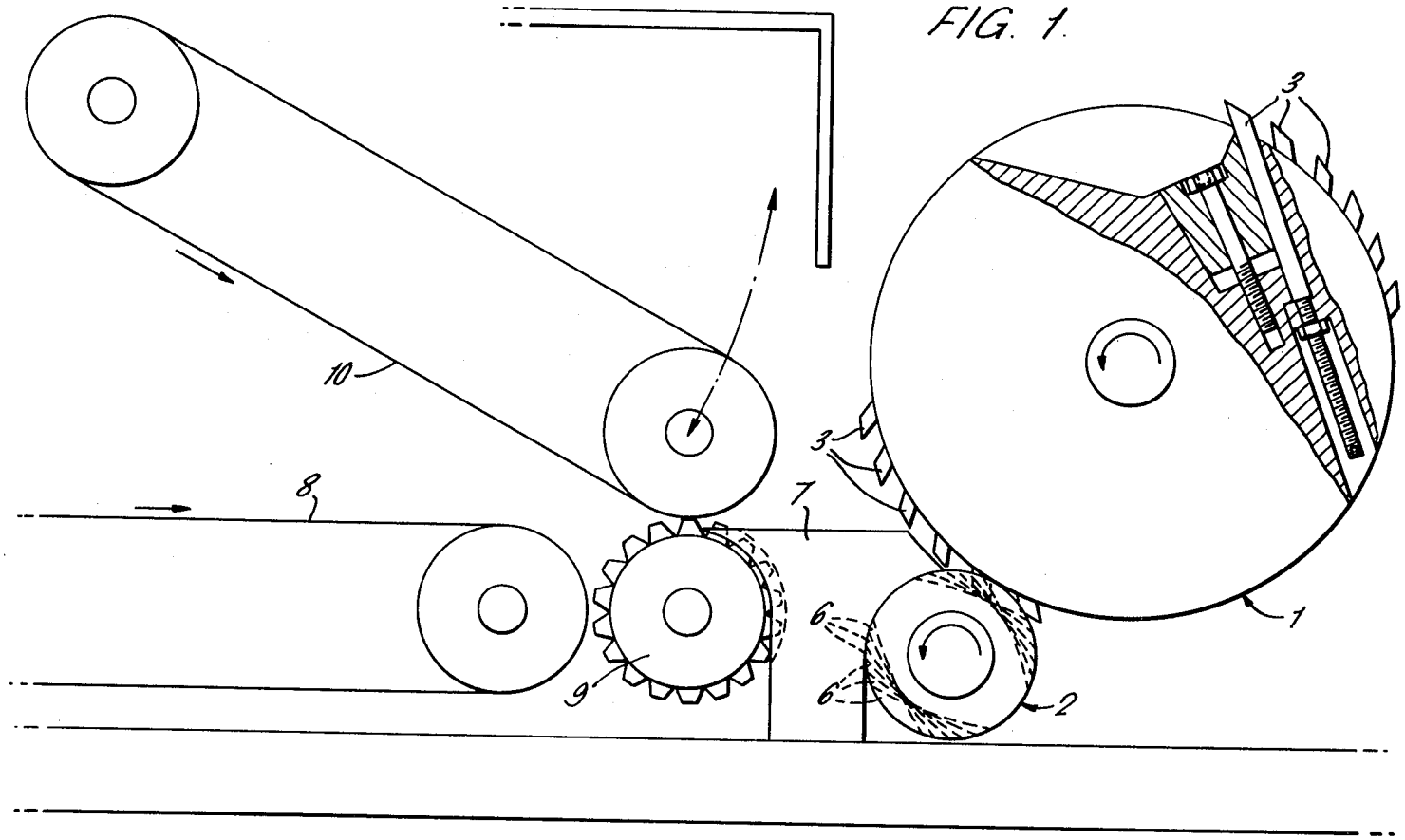
Figure 2:
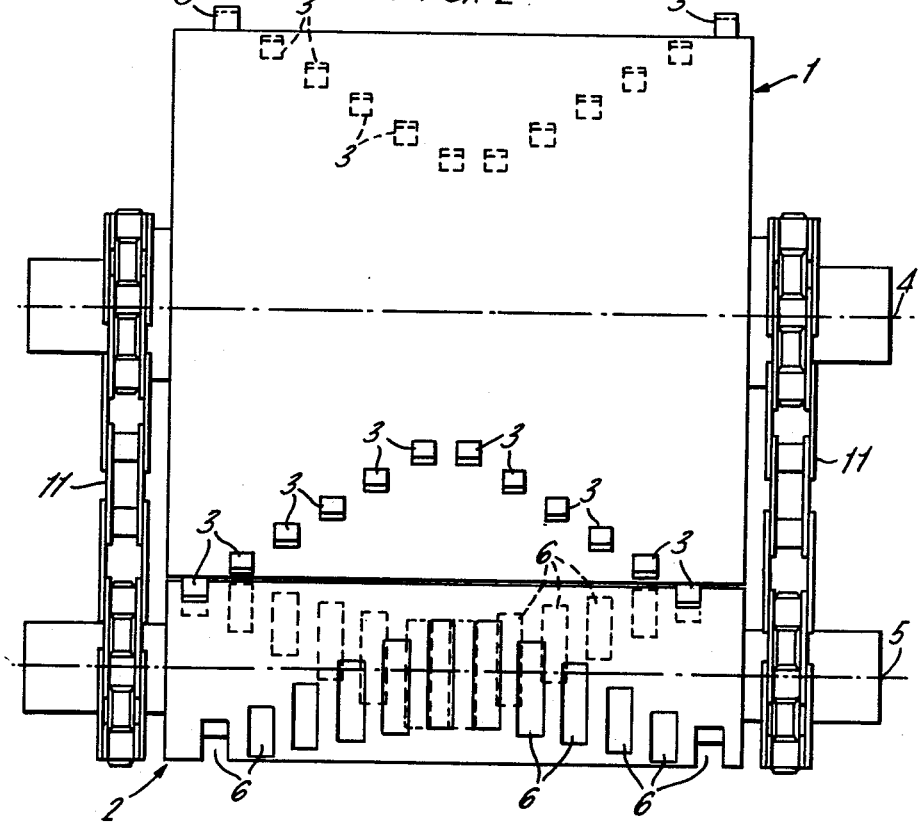
Figure 3:
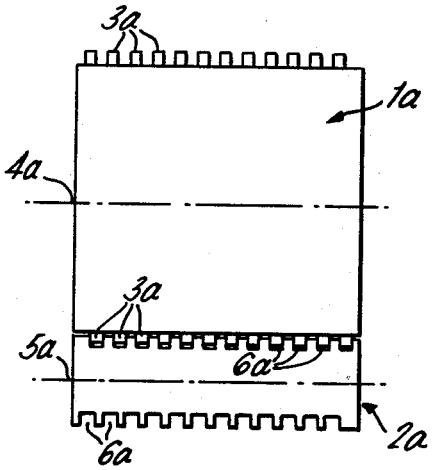

The invention will be more clearly understood from the following description and from the attached drawings, wherein FIG. 1 is a schematic side view of one embodiment of a chipper in accordance with the present invention, FIG. 2 shows the blade drum and the coacting counter-blade viewed in the direction of feeding of the wood material and perpendicular to the plane determined by the axes of rotation of the blade drum and the counter-blade, FIG. 3 shows an alternative embodiment to that of FIGS. 1 and 2 with respect to the positioning of the blades on the blade drum and of the recesses on the counter-blade.

Figure 4:
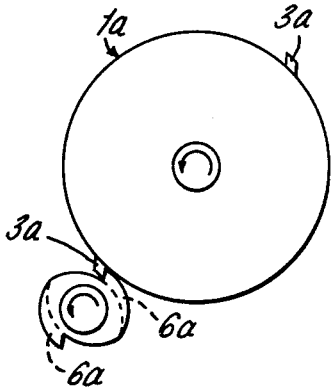

FIG. 4 is a side view of the embodiment of FIG. 2.

As is shown in FIG. 1, the chipper includes a feeder for wood material, which feeder comprises a horizontal metallic belt conveyor 8, adjacent the chipper, followed by a toothed roller 9. Above, near the chipper, there is a short compressing metallic belt conveyor 10, which is mounted pivotably so that the end next to the chipper presses the material to be chipped against the lower conveyor 8. The feeder is operated, for example, by two hydraulic motors (not shown).

The blades 3 of the blade drum 1 are detachable and are placed on the drum 1 in two arrow-shaped rows as shown in FIG. 2 so that the blades of the second row are staggered, in the direction of width of the drum 1, between the blades of the first row. The distance between the blades in the row is equal to the width of the blade 3. The blades are fastened to the drum 1 individually and can be adjusted and replaced easily. The drum is operated, for example, directly from a diesel engine (not shown) by means of V-belt transmission (also not shown).

The counter-blade consists both of a stationary component and of a rotary component. The stationary counter-blade 7 has, as usual, an edge whose width is equal to that of the drum 1. The blades 3 on the drum 1 are adjusted so that there is a little play between blades 3 and the edge of stationary counter-blade 7. The rotary counter-blade 2 is a smaller drum which rotates at the same rate as the chipper drum 1 and in the same direction. Only a space of approximately 1 mm remains between the cylinder faces of the drums 1 and 2, which prevents the passage of unchipped particles through the chipper. The surface of the counter-blade drum 2 is provided with recesses 6, one for each blade 3 of the blade drum, and the recesses are positioned so that the blade 3 on the drum 1 and the recess 6 on the counter-blade 2 reach the same position at the same time. The circumferences of the cylinders move in opposite directions at the tangent point, for which reason no wedging roller effect is produced. The counter-blade 2 is synchronized by means of chain or cog transmission 11 with the rate of rotation of the blade drum 1. The recesses 6 on the surface of the counter-blade 2 in positions corresponding the blades of the blade drum 1 are shaped so as to substantially match the recess to the shape of blades 3 in order to permit the rotary movement of the blade drum 1 and the counter-blade 2.

When chipping entire trees, the chipper in accordance with the present invention operates so that, when, for example, entire trees intended for pulp industry are felled in the forest, the felled tree is fed as such into the chipper, i.e. without removal of the branches from the trunk or cutting and de-barking the trunk. In this way the apparatus chips the trunk of the tree by means of narrow blades 3, which are of a predetermined width, when required, so that the chips of the trunk tree are produced as chips of a predetermined width, thickness and length. No bark adheres to the trunk wood chips because it is removed from the tree by the action of narrow blades 3 of the blade drum 1 and rotary counter-blade 2. Since, chips can pass through the chipper only through the recesses 6 on the counter-blade 2, these recesses determine the maximum particle size of the chips. As to the branches on entire trees, the chipper operates so that the branches that are fastened to the trunk have to pass into the chipper in a transverse position. The narrow blades 3 chip the branches in any position whatsoever into chips of predetermined length by means of the rotary counterblade. If the branches are thick, the chipper blades 3 first cleave through such branches. The chipper also removes all the bark from the branches by means of the rotary counter-blade 2.

Similarly, by means of this chipper it is also possible, to chip tree tops, bushes and small trees, besides entire trees, into raw material for pulp, paper, cardboard, chipboard, and the like.

It is also entirely possible to chip branches alone by means of this chipper because of its narrow blades 3, the location of straight counter-blade 7 above, the rotary counter-blade 2. This is accomplished as follows:

When branches alone are fed into the chipper by means of metallic feeding belts 8 and 10, the feeding belts 8 and 10 carry the branches, in any position whatsoever, straight against the blade drum 1 of the chipper, provided with narrow blades 3. The narrow blades 3 on the drum 1 then cut through any branches thicker than the predetermined thickness against the upper straight counter-blade 7 and carry along with them downwards any branches that are thinner than the predetermined thickness, whereupon the thinner branches pass down between the stationary counter-blade 7 and the blade drum 1 onto the rotary counter-blade 2, which first removes any bark from the branches. When the narrow blades 3 of the drum 1 come against the rotary counter-blade 2, the recesses 6 are opposite blades 3. Blades 3 then cut all thin branches and portions of the cut thick branches against the side edges of recesses 6. Blades 3 then pass through recesses 6 and carry the produced branch chips to point of removal, from where they can be removed in many different ways, e.g. by filling exchangeable lorry platform boxes, trailer boxes, sacks, onto the ground, and the like.

The blowing power of the chipper is, as a rule, insufficient to move the chips far enough. This is why a centrifugal fan (not shown) is designed to be placed after the chipper, which fan provides sufficient additional power to the shifting of the chips.

The chipper is a complete unit with a frame, feeder, and power machine of its own. These items do not constitute part of the present invention and have been omitted to avoid unduly complicating the drawings. It the chipper can be used equally well for a stationary installation or mounted on a mobile frame.

In the chipper in accordance with the present invention, the stationary counter-blade 7 operates as a base and support especially when trunks and trees are passed into the machine in the longitudinal direction. Thin trees entering the chipper in the transverse direction, such as branches and other timber-felling waste, often pass by the stationary counter-blade 7 but are chipped through the recesses 6 of the rotary counter-blade 2. The bark, needles and leaves of the trees are detached by the rotary counter-blade 2 from all the chips and are ground into a very small particle size powder which can be removed from the chips and be blown off the chipper straight into the forest, where they produce highly important humus.

Because of the characteristics described above, this chipper is capable of preparing chips from different wood raw materials.

FIGS. 3 and 4 show another embodiment of the chipper in accordance with the present invention. As can be seen from FIG. 3, the embodiment there disclosed comprises a blade drum 1*a* and a counter-blade 2*a*, each rotatable about parallel axes 4*a* and 5*a*, respectively. Blade drum 1*a* differs from blade drum 1 in that blades 3*a* are arranged in a row across the width of drum 1*a*, instead of the arrow-shaped array shown in FIG. 2. As also shown in FIGS. 3 and 4, counter-blade 2*a* was modified so that recesses 6*a* are also arranged in a straight, axially parallel line across the width of counter-blade 2*a*. Referring to FIG. 4 in particular, it will be seen that in the embodiment there shown, blade drum 1*a* and counter-blade 2*a* also rotate in the same angular direction so that, at their point of tagency, the respective surfaces actually travel in opposite directions.

What we claim is:

1. A chipper for chipping various wood material, such as entire trees, branches, tree tops, bushes, and small trees, said chipper having a feed end and an output end, said chipper comprising:

(a) a rotatable, cylindrical blade drum having a plurality of finger-shaped blades projecting from the cylindrical surface of said blade drum, said blades being spaced from each other in the longitudinal direction of said blade drum;

(b) a cylindrical, rotatable counter-blade, rotatable in the same direction as the blade drum about an axis parallel to that of said blade drum;

(c) a plurality of recesses provided on the surface of the rotatable counter-blade arranged to coincide with the finger-shaped blades on the surface of the blade drum, said recesses corresponding in shape to the shape of said blades, said blade drum and rotatable counter-blade being spaced sufficiently close so as not to permit chipped wood to pass between the cylindrical surfaces of said blade drum and rotatable counter-blade;

(d) means connected to the blade drum and rotatable counter-blade for synchronously rotating said blade drum and said counter-blade to successively position each blade in its corresponding recess; and (e) a stationary counter-blade at the feed end of the chipper so mounted as to be in close proximity to the cylindrical surface of the rotatable counter-blade and to the rotating blades on the blade drum.

2. A chipper as claimed in claim 1, wherein the finger-shaped blades are placed on the blade drum in two or more rows, and that in two successive rows, the blades are placed so that the blades of the second row are staggered axially, whereby said blades of said second row are positioned in the spaces between the blades of the first row in the axial direction of the blade drum and the rows of recesses on the surface of the counter-blade are positioned so that they coincide with the rows of blades of the blade drum.

3. A chipper as claimed in claim 1, wherein the finger-shaped blades are placed on the blade drum in two rows of blades in which the blades are positioned so that, in the direction of the axis of the blade drum, intermediate spaces equal to the width of a blade always remain between the blades, the blades of the second row are placed on the blade drum in said intermediate spaces and the rows of recesses on the surface of the counter-blade are placed so as to coincide with the rows of blades on the blade drum.

4. A chipper as claimed in claim 1, wherein the diameter of the cylindrical counter-blade is smaller than the diameter of the cylindrical blade drum.

* * * * *